US007578297B2

(12) United States Patent
Villarinho

(10) Patent No.: US 7,578,297 B2
(45) Date of Patent: Aug. 25, 2009

(54) MACHINE FOR OPENING CIGARETTE PACKS AND INSPECTING CIGARETTES

(75) Inventor: Ricardo Villarinho, Rio de Janeiro (BR)

(73) Assignee: Souza Cruz S.A., Rio de Janeiro (BR)

( * ) Notice: Subject to any disclaimer, the term of this patent is extended or adjusted under 35 U.S.C. 154(b) by 461 days.

(21) Appl. No.: 10/554,198

(22) PCT Filed: Dec. 18, 2003

(86) PCT No.: PCT/BR03/00198

§ 371 (c)(1),
(2), (4) Date: Nov. 15, 2006

(87) PCT Pub. No.: WO2004/095956

PCT Pub. Date: Nov. 11, 2004

(65) Prior Publication Data

US 2007/0102015 A1 May 10, 2007

(30) Foreign Application Priority Data

Apr. 25, 2003 (BR) ..... 0301064

(51) Int. Cl.
*A24C 5/32* (2006.01)
*A24C 5/34* (2006.01)

(52) U.S. Cl. ..... 131/281; 131/283; 131/285

(58) Field of Classification Search ..... None
See application file for complete search history.

(56) References Cited

U.S. PATENT DOCUMENTS 2,991,879 A * 7/1961 Innocenti ..... 209/3.1
3,939,984 A 2/1976 Butner et al.
6,006,438 A * 12/1999 Shrider ..... 33/626

FOREIGN PATENT DOCUMENTS

| | | | |
|---|---|---|---|
| DE | 100 24 284 | A1 | 11/2001 |
| DE | 101 35 484 | A1 | 1/2003 |
| EP | 0 447 208 | A2 | 9/1991 |
| EP | 0 534 623 | A1 | 3/1993 |
| EP | 0 570 163 | A2 | 11/1993 |

* cited by examiner

*Primary Examiner*—Philip C Tucker
*Assistant Examiner*—Michael J. Felton
(74) *Attorney, Agent, or Firm*—Birch, Stewart, Kolasch & Birch, LLP

(57) ABSTRACT

The present invention refers to a machine for opening cigarette packs and inspecting cigarettes (1), used to recover cigarettes contained in soft cup type packs (72), comprising: cigarette pack accumulator (2); transfer channel (3); first drum (4); cigarette pack holding pouches (27); device for opening the flaps of the aluminum foil lining (28); guide means (42); flap pressing and label housing displacing device (29); unopened packs rejection device (52); second drum (5); guide means; cigarette storage bin (6); counter-rotating roll (54); inspection drum (9); cigarette inspection device (57); cigarette rejection device; storage bins for label housings (12), aluminum foil linings (13), and cigarettes (11); rejected packs storage bin (22); selected cigarettes collector belt (10); and frame (71).

7 Claims, 14 Drawing Sheets

MACHINE FOR OPENING CIGARETTE PACKS AND INSPECTING CIGARETTES

FIELD OF THE INVENTION

The present invention refers to a machine for opening packs of cigarettes and inspecting the cigarettes, which is used to recover cigarettes contained in soft cup type packs.

BACKGROUND OF THE INVENTION

During the process of production of cigarette packs, the packs that are rejected by the packaging machines due to not meeting the previously established quality standards are usually conveyed to a storage bin located at the machine's rejection station.

At present, the process used to recover the cigarettes contained in the soft cup type packs is a manual process, that is, there is no equipment to perform neither the opening of the packs nor the inspection nor reclaiming of the cigarettes contained therein.

In the manual cigarette reclaiming process, the individual in charge of performing the task displaces himself or herself to the packaging machine's rejection station, picks up the storage bin with the rejected packs, and takes the same to an inspection location, where the rejected packs are placed in one other storage bin, whereupon the empty storage bin is returned to the rejection station.

On returning to his or her work location, the individual opens the packs manually one by one, stripping therefrom the tax stamp, the polypropylene film, the label housing and the aluminum foil lining. Subsequently, the employee performs a visual inspection of a group of cigarettes previously contained in the pack. The cigarettes that such individual deems not to meet the quality standards are stored in a cardboard bin.

When the inspection location storage bin is empty, the employee collects from the machine another storage bin full of packs to be opened, and continues to perform the process.

The tasks described above are performed repetitively until the cardboard box is filled with cigarettes, whereupon the cigarettes are returned to the production process.

The manual process has some unsatisfactory aspects, among which there may be pointed out the shortcomings in terms of quality, the productivity limitations and the high costs involved.

The quality-related shortcomings are strongly present in the manual process, since the result of the cigarette inspection is dependent upon a subjective analysis of the individual that performs the same. As a rule, the individual withdraws all the cigarettes from the pack and inspects the same visually all together at once.

Productivity is limited in the manual process, since that depending on the packaging machine and the quality of the raw materials, the rejection level is subject to variance. Since the quantity of rejected packs increases in proportion to an increase in the speed of the packaging machine, the individuals in charge of inspecting the cigarettes are unable to keep up with such variance, entailing an accumulation of debris, deterioration of the rejected packs and being detrimental to the organization of the manufacturing sectors. Thus, in order to solve this problem, the speed of the packaging machine is reduced.

The costs involved in the manual process are quite high, due to the requirement of a large quantity of direct and indirect labor, and the cigarette recovery rates are limited, which increases the raw material and product costs.

ADVANTAGES OF THE PRESENT INVENTION

The present invention discloses a machine that will perform the work of recovery and inspection of cigarettes, currently performed in manual fashion, providing innumerous advantages, among which there may be pointed out the following:

lesser quality shortcomings, as the machine itself will perform an electronic inspection of the unpackaged cigarettes one by one, allowing more reliability in the results and thus obviating the dependency on subjective human analysis;

increase in pack opening speed, as there is thus provided an increased capacity for keeping up with the increase in the rejection rate of the packaging machines, with the benefit of reduced accumulation of debris and thence reduced deterioration of the rejected cigarettes and better organization of the manufacturing sectors; and substantial decrease in the activity's costs, since by substituting the manual process with the machine according to the present invention the rejected cigarette recovery levels will increase substantially, reducing the costs arising from loss of raw material and damaged cigarettes, and in addition, with the use of the instantly disclosed innovation, the large number of individuals required for performance of the activity will no longer be required, providing a decrease in direct and indirect labor-related costs.

DESCRIPTION OF THE INVENTION

The present invention refers to a machine for opening cigarette packs and inspecting cigarettes, which primary purpose is to recover, using mechanical and electronic devices, any cigarettes that are found to meet the previously established quality standards. Therefore, the equipment according to the present invention is capable of extracting the cigarettes from within a soft cup type pack, inspecting such cigarettes and, where feasible, returning them to the production process.

The primary object achieved with the machine according to the present invention is maximum recovery of cigarettes to the production process with little handling and less impact to productivity and quality of the product.

Therefore, the present invention discloses a machine for opening cigarette packs and inspecting cigarettes, used to recover cigarettes contained in soft cup type packs, which comprises the devices that are described below.

A pack accumulator containing a plurality of pack storage channels, the channels being moved by means of two link-block belts traveling in opposite directions, the belts being driven by one or more driving means. The channels may be transferred from one belt to the other by means of actuation of two pneumatic pistons.

A transfer channel shaped as a half-tube with rectangular cross section comprising guide means.

A first drum, comprised by a fixed inner cylinder, attached to the machine frame, and a movable outer cylinder driven by a driving device, by means of cogged belts and pulleys, providing an intermittent motion thereto. The inner cylinder is provided along its length with a plurality of openings, and its internal space is under vacuum. Along the periphery of the outer cylinder there are also provided a plurality of orifices. The first drum further comprises a compressed air pipe line that passes through both cylinders and reaches the surface of the outer cylinder.

Pack holding pouches attached to the surface of the outer cylinder, containing a plurality of orifices aligned with the orifices of the outer cylinder when the pouch is in its initial position. Each pouch is preferentially coated on the inside with polyurethane to provide a high level of adherence between its contact surface and the pack label housing surface when a vacuum is applied. The base of each pouch is movable and at one of the ends thereof there is provided a roller that rolls along a cam path, allowing the pouch to return to its initial position.

A device for opening the flaps of the aluminum foil lining, which function is to open and ensure full opening of the flaps of the aluminum foil lining located at the top of the pack even if the same are stuck due to an excess of adhesive on the side of the label housing closure seam and/or the tax stamp on the closure seam. The device is comprised of a pneumatic actuation piston, a claw, bearings and a motion absorber.

A guide means, attached to the flap pressing and label housing displacing device, which maintains full opening of the two flaps of the aluminum foil lining for subsequent attachment thereof to the flap pressing and label housing displacing device itself.

A flap pressing and label housing displacing device which purpose consists in holding the aluminum foil lining in place while removing the label housing. The device comprises two pneumatic actuation pistons that drive the two flap presses, one pneumatic actuation piston that drives the pushrods and one device which applies suction to and discards the label housing.

A device for rejecting unopened packs, comprising a sensor, a pneumatically actuated piston and pushrods.

A second drum, which is intended for removing the aluminum foil lining, comprised of a fixed inner cylinder, attached to the machine frame, and a movable outer cylinder driven by a driving device, by means of cogged belts and pulleys, providing an intermittent motion thereto. The inner cylinder is provided along its length with a plurality of openings, and its internal space is under vacuum. Along the periphery of the outer cylinder there are also provided a plurality of orifices.

Guide means for opening the top and bottom folds of the aluminum foil lining to facilitate the opening and unfolding thereof, when passing through the intersection of the first drum with the second drum.

A cigarette storage bin preferably made of polycarbonate, intended for storage of the cigarettes that are released from the aluminum foil lining.

An inspection drum to receive the cigarettes coming from the cigarette storage bin. In order to avoid that the cigarettes become crushed in the cigarette storage bin, due to the rotating motion of the inspection drum, there is positioned a "counter-rotating roll" which inhibits the pressure of the column of cigarettes. The inspection drum is formed by a fixed inner cylinder, attached to the machine frame, and a movable outer cylinder driven by a driving device, by means of cogged belts and pulleys, providing a continuous motion thereto. The inner cylinder is provided along its length with a plurality of orifices, and its internal space is under vacuum. Along the periphery of the outer cylinder there are provided channels capable of storing one single cigarette, which will be held by means of vacuum, and there are also provided a plurality of orifices to allow the action of the vacuum and orifices located centrally on the channels in communication with a compressed air pipe line in the cigarette rejection region.

A cigarette inspection device comprising an optical sensor which detects the presence of the filter and an infrared sensor that checks the condition of the tobacco tube portion.

A cigarette rejection device that receives the signal from the inspection device and performs the operation of rejecting a cigarette that fails to meet the quality standard by means of a jet of air blown through an opening located centrally on the channel.

Storage bins for label housings, aluminum foil linings and cigarettes, wherein are stored the objects discarded by the machine. Each storage bin comprises a fan and conveying ducts. The fan causes the suction of the discarded material to be conveyed through the ducts to the corresponding storage bin.

Rejected packs storage bin, comprised of a bin located on the underside of the machine and a conveying duct.

Cigarette collection belt, driven by the inspection drum driving means, to receive and carry the inspected cigarettes that do not evidence problems such as tips empty of tobacco and absence of filter.

A frame whereto are attached all the components of the machine, such as the inner cylinders of the first and second drums and of the inspection drum, and also the protection casing elements. Next to the frame there is a control panel.

The vacuum present inside the inner cylinders of the first drum, the second drum and the third drum (inspection drum), as well as the compressed air used by the machine, may be provided by the utility lines of the factory itself where the machine is installed. However, the machine may optionally comprise an auxiliary vacuum pump.

BRIEF DESCRIPTION OF THE DRAWINGS

An embodiment of the machine for opening cigarette packs and inspecting cigarettes that constitutes the object of the present invention is shown in the attached drawings, wherein.

DESCRIPTION OF THE PREFERRED EMBODIMENT OF THE PRESENT INVENTION

Figure 1:
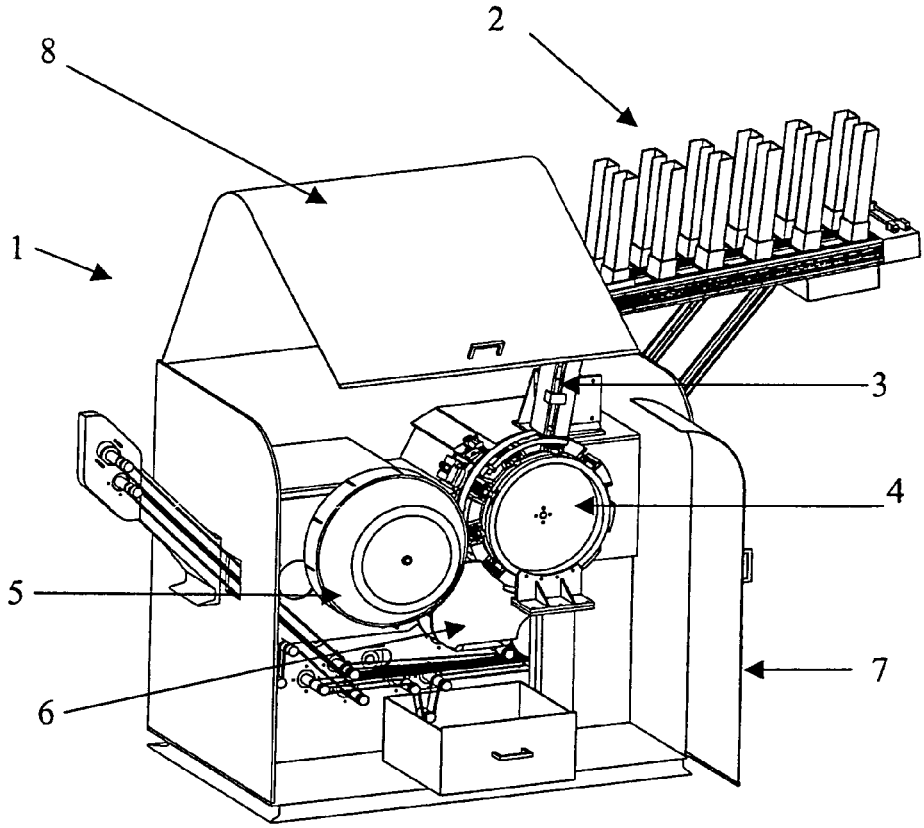
FIG. 1 is an isometric perspective view of the cigarette pack opening and cigarette inspecting machine that is the object of the present invention.
Figure 2:
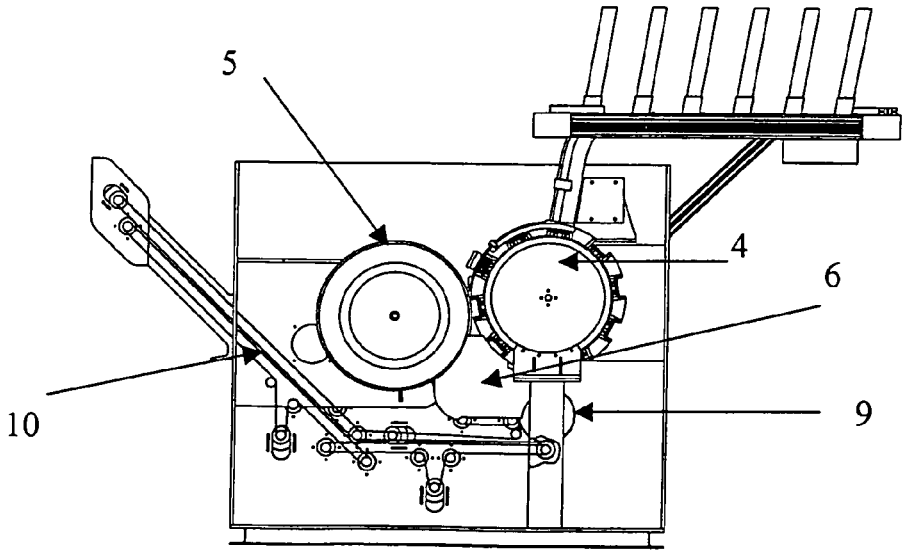
FIG. 2 is a front view of the cigarette pack opening and cigarette inspecting machine that is the object of the present invention.
Figure 3:
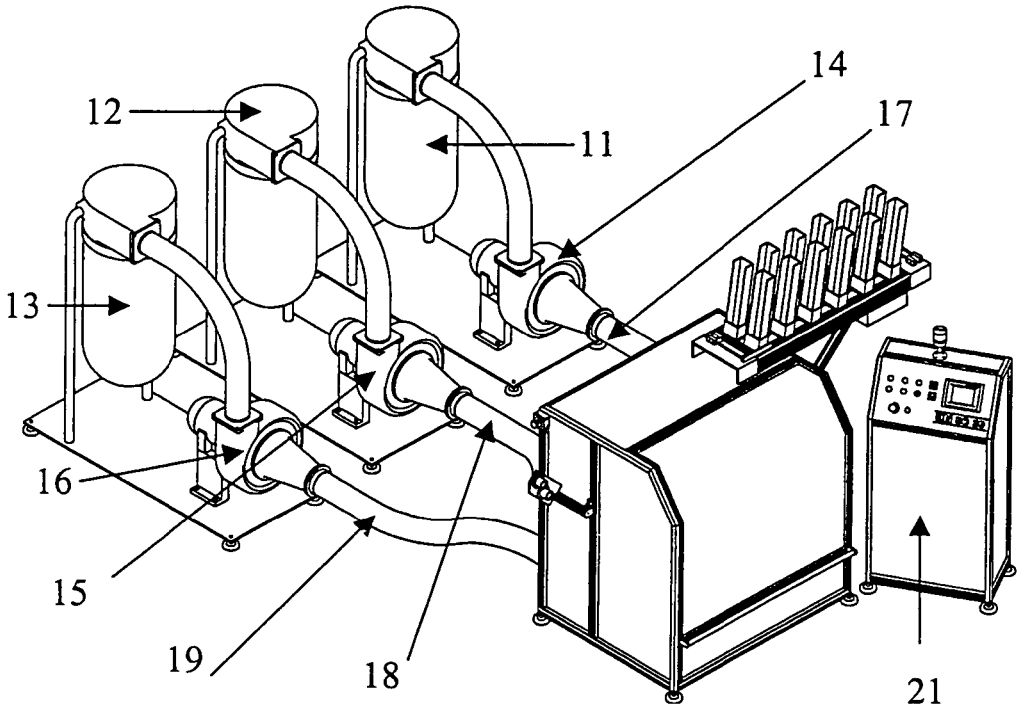
FIG. 3 is an isometric perspective view of the cigarette pack opening and cigarette inspecting machine that is the object of the present invention, wherein are also shown the storage bins for label housings, aluminum foil linings and rejected cigarettes, as well as the control panel of the machine.
Figure 4:
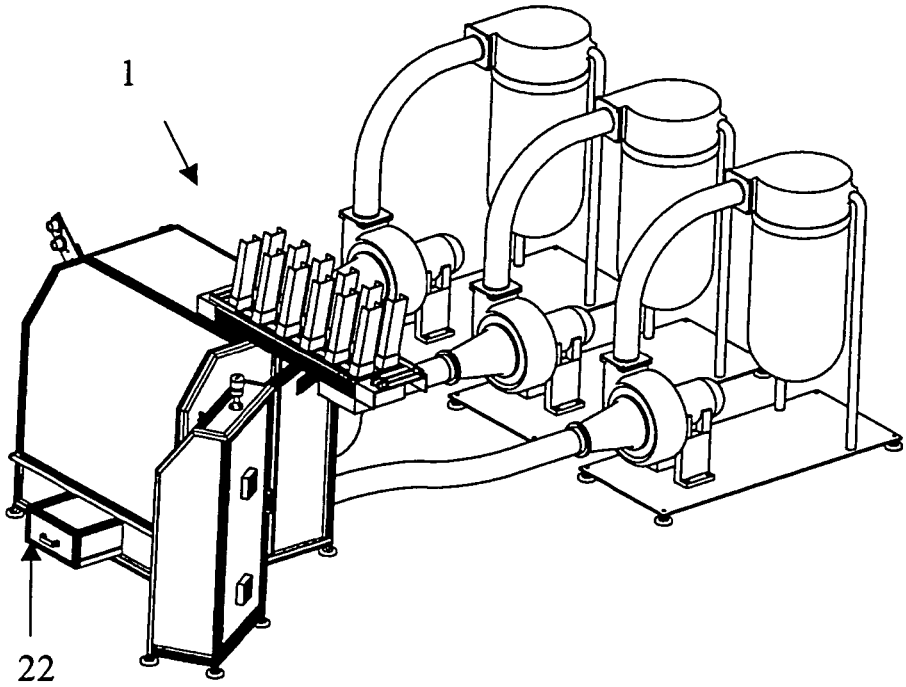
FIG. 4 is another isometric perspective view of the cigarette pack opening and cigarette inspecting machine that is the object of the present invention, wherein are also shown the storage bins for label housings, aluminum foil linings and rejected cigarettes, as well as the control panel of the machine and the rejected packs storage bin.
Figure 5:
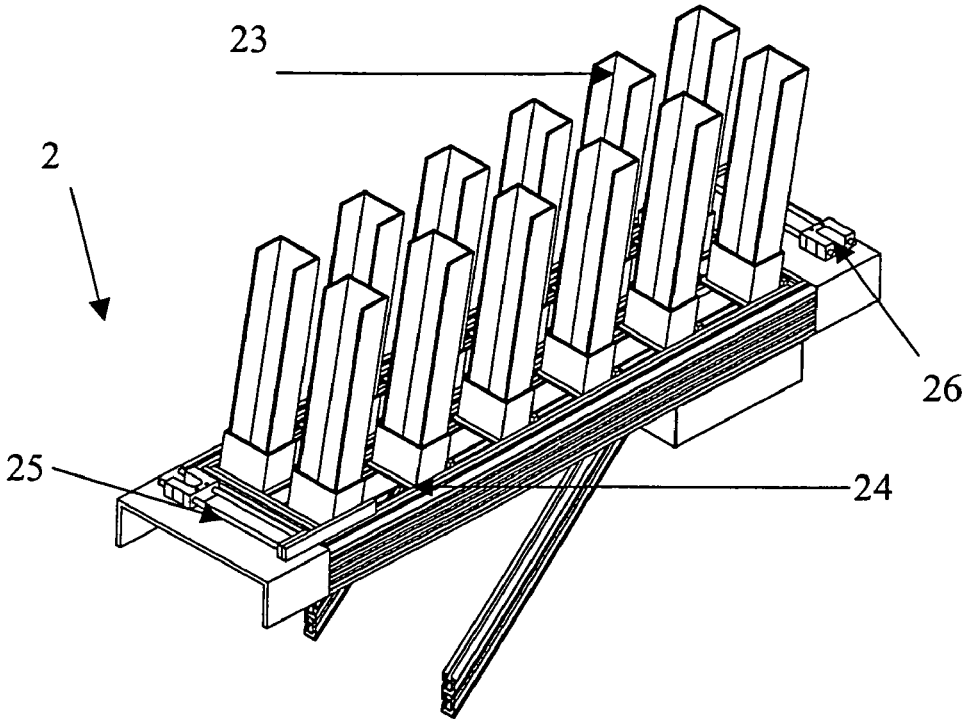
FIG. 5 shows the cigarette pack accumulator.
Figure 6:
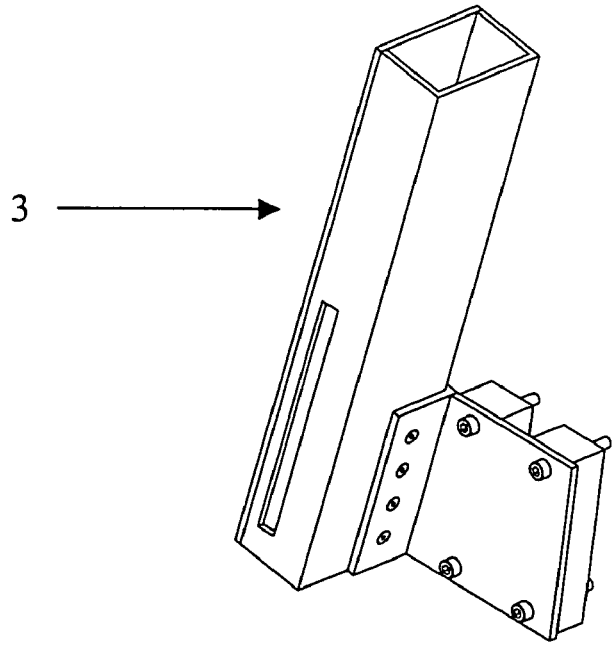
FIG. 6 shows the transfer channel.
Figure 7:
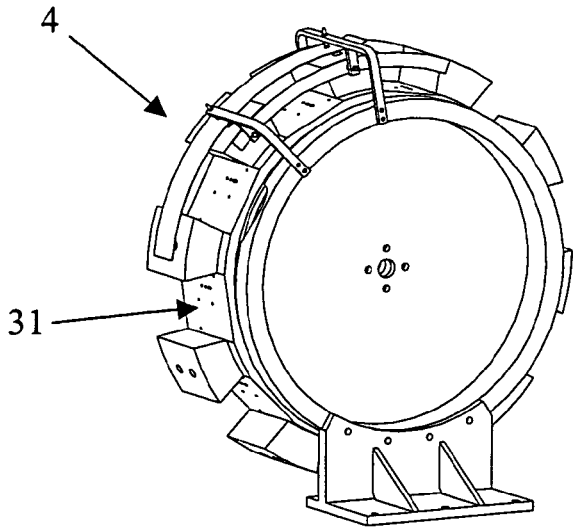
FIG. 7 shows the first drum.
Figure 8:
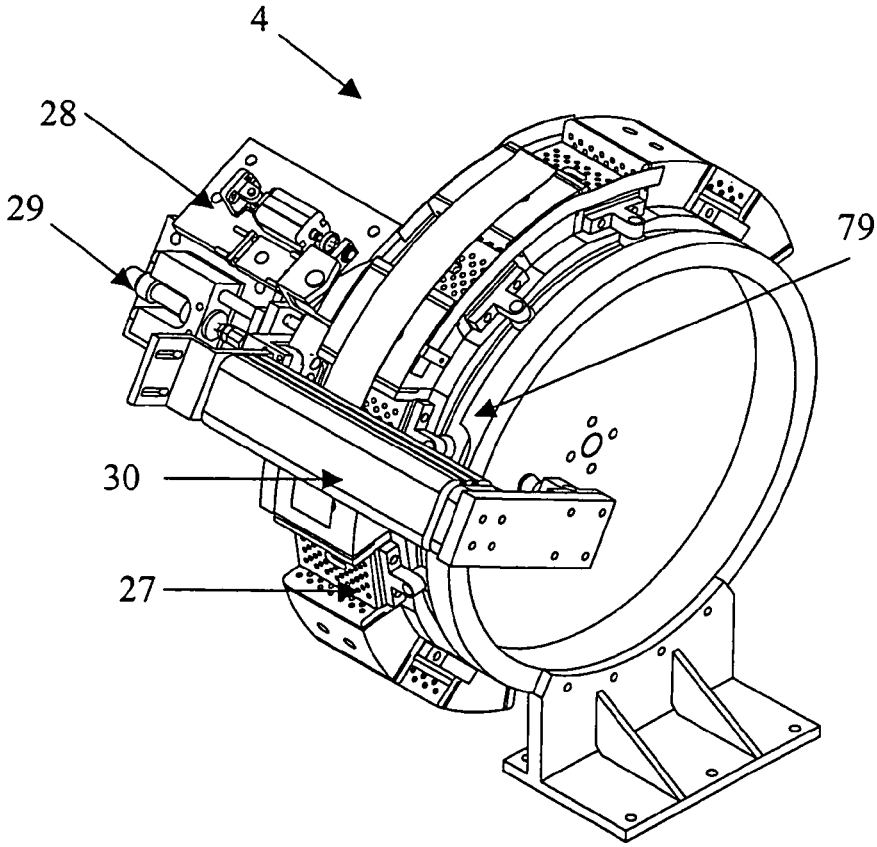
FIG. 8 shows the first drum with the holding pouches, the aluminum foil lining flaps opening device, the flaps pressing and label housing displacing device and the cam path.
Figure 9:
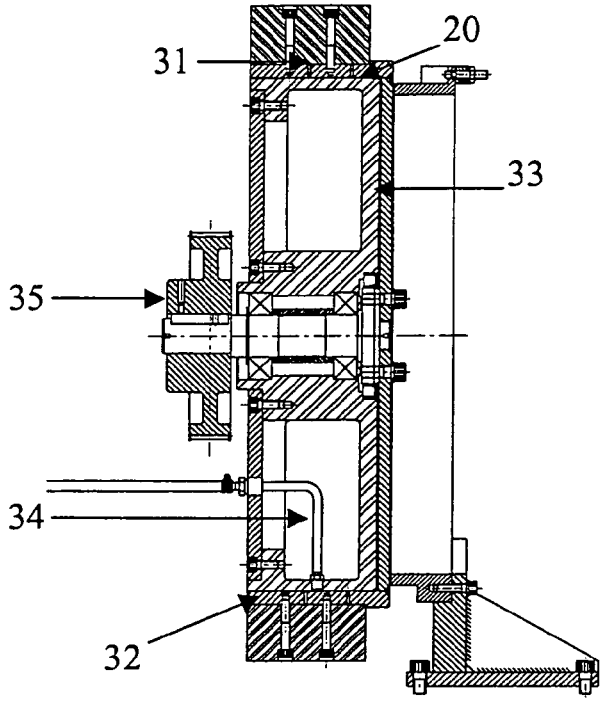
FIG. 9 shows a cross section view of the first drum, wherein are depicted the inner cylinder, the outer cylinder and the compressed air pipe line.
Figure 10:
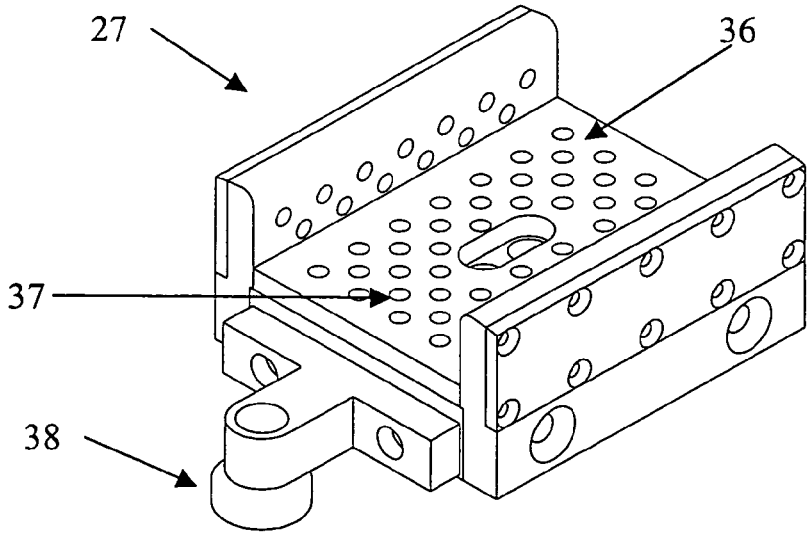
FIG. 10 shows the pack holding pouch.
Figure 11:
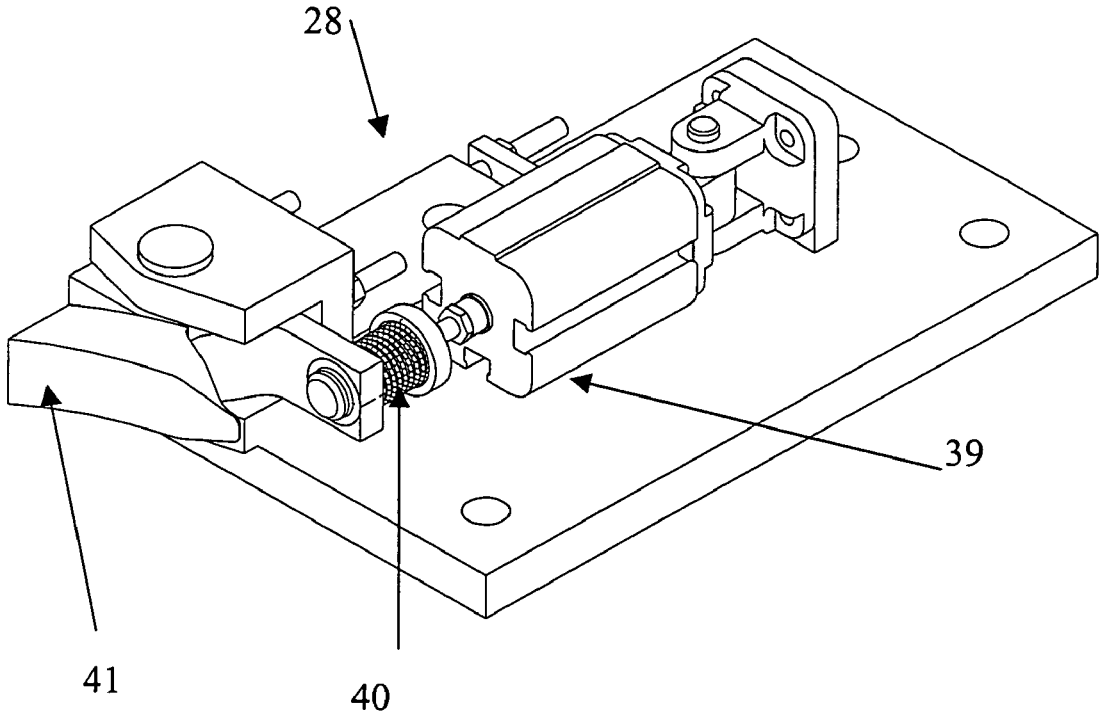
FIG. 11 shows the aluminum foil lining flaps opening device.
Figure 12:
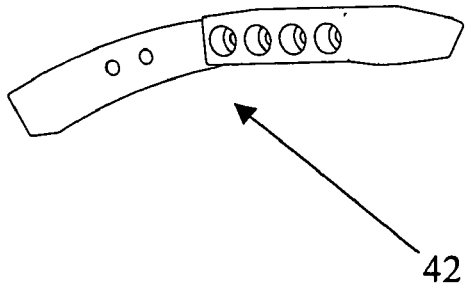
FIG. 12 shows the guide means that keeps open the aluminum foil lining flaps.
Figure 13:
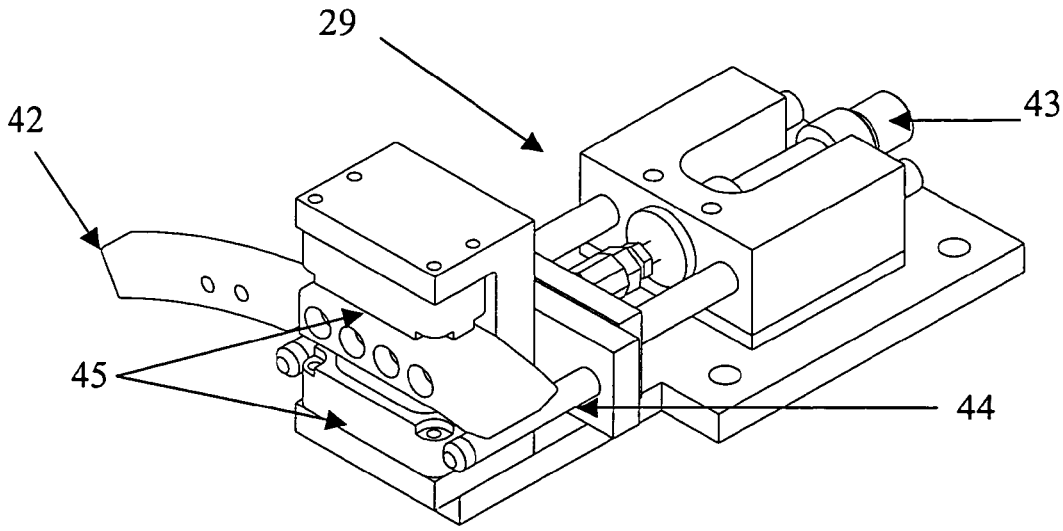
FIG. 13 shows the flap pressing and label housing displacing device.
Figure 14:
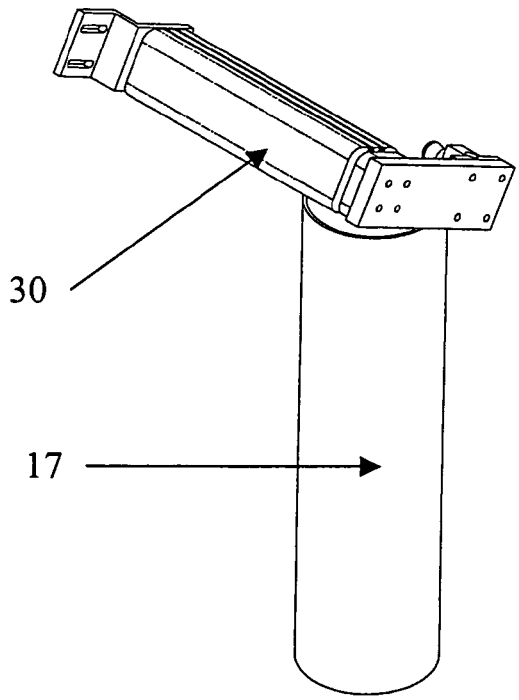
FIG. 14 shows the device that applies suction to and rejects the label housing, and the label housing conveying duct.
Figure 15:
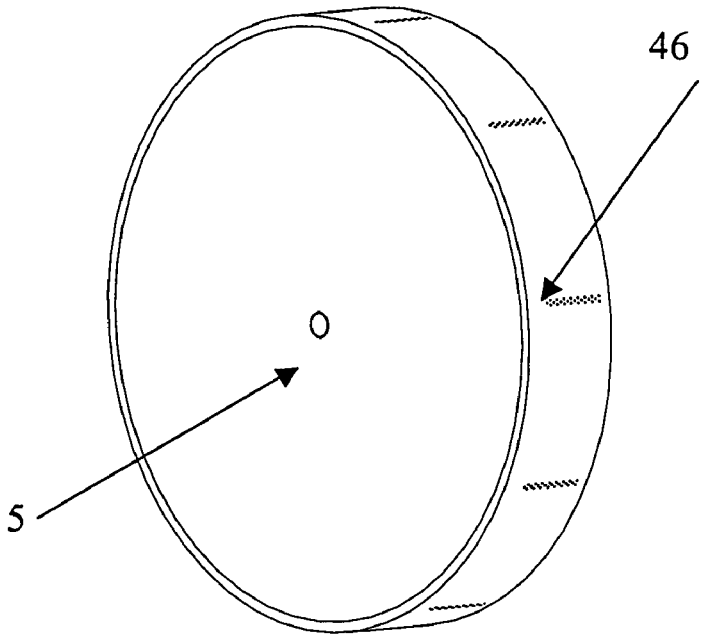
FIG. 15 shows the second drum.
Figure 16:
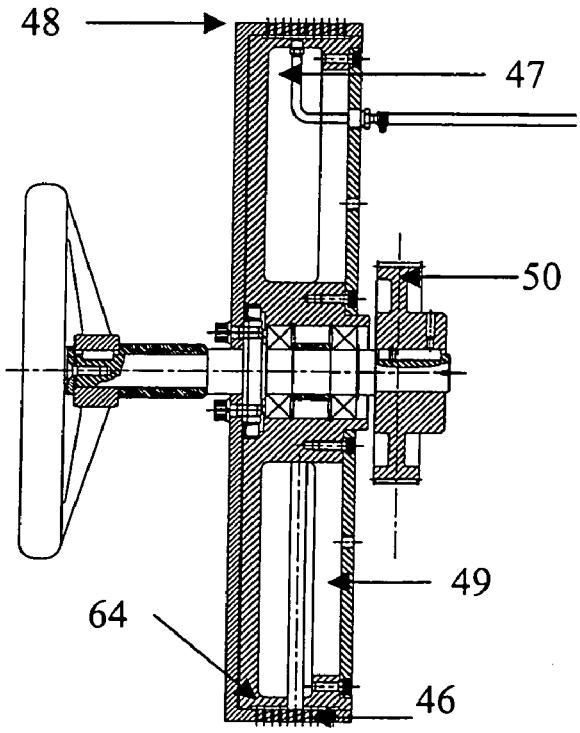
FIG. 16 is a cross section view of the second drum, wherein are depicted the inner cylinder, the outer cylinder and the compressed air pipe.
Figure 17:
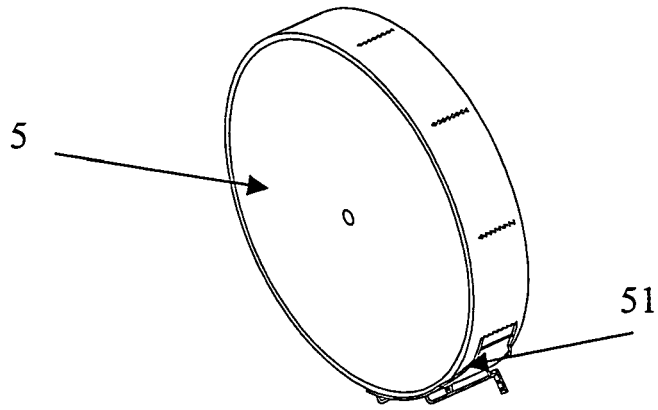
FIG. 17 shows the guide means for opening the top and bottom folds of the aluminum foil lining, and the second drum.
Figure 18:
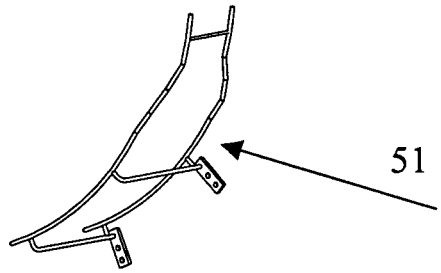
FIG. 18 shows the guide means for opening the top and bottom folds of the aluminum foil lining.
Figure 19:
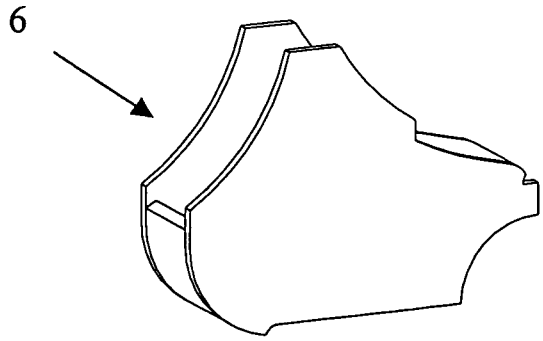
FIG. 19 shows the cigarette storage bin.
Figure 20:
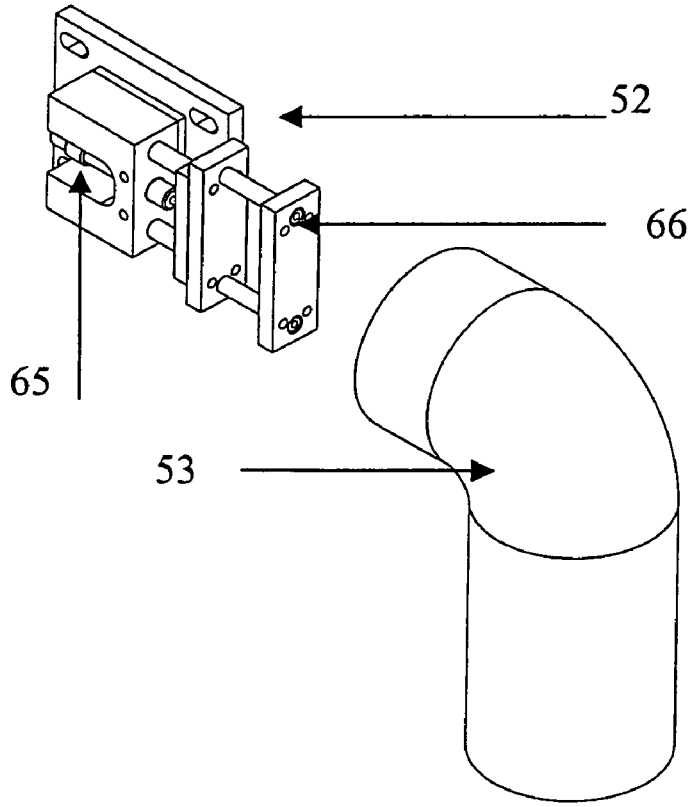
FIG. 20 shows the cigarette pack rejection device and the conveying duct for the rejected pack.
Figure 21:
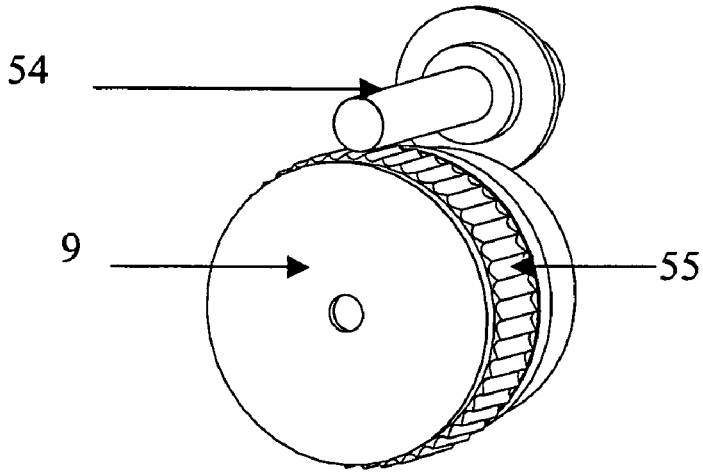
FIG. 21 shows the inspection drum and the counter-rotating roll.
Figure 22:
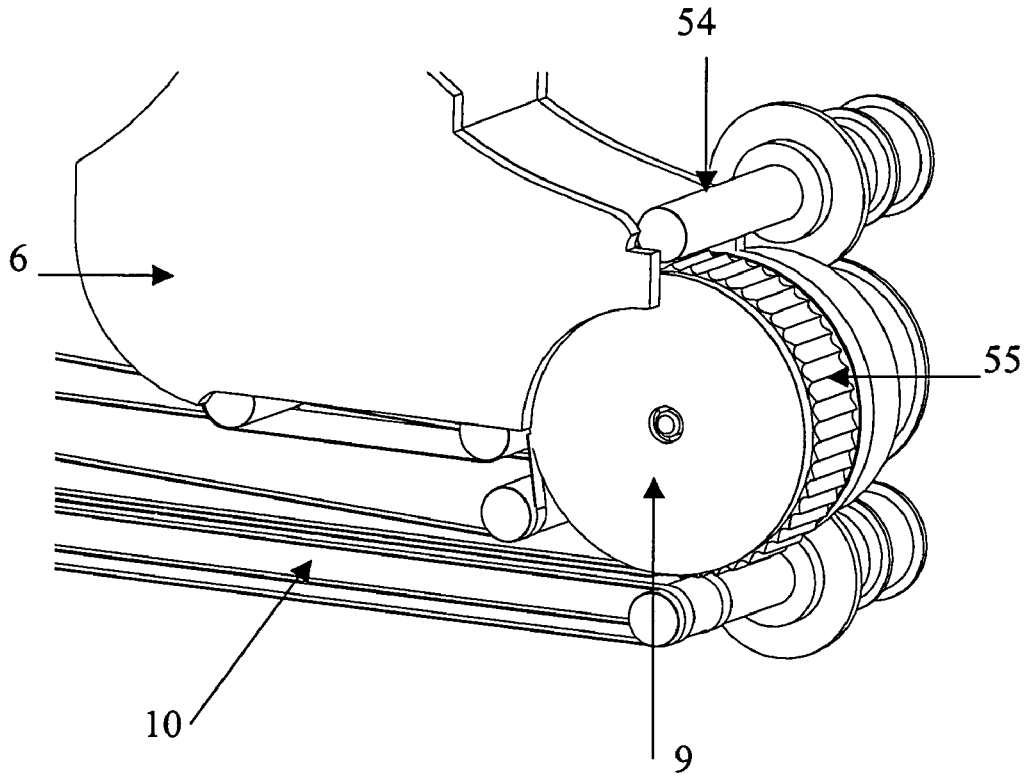
FIG. 22 shows the inspection drum and the counter-rotating roll, the cigarette storage bin and the selected cigarettes collection belt.
Figure 23:
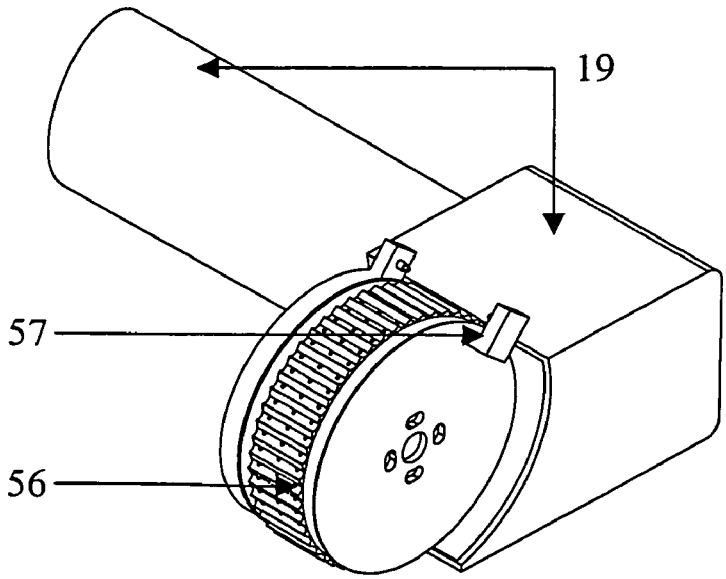
FIG. 23 shows the inspection drum with the inspection device and the rejected cigarettes conveying duct.
Figure 24:
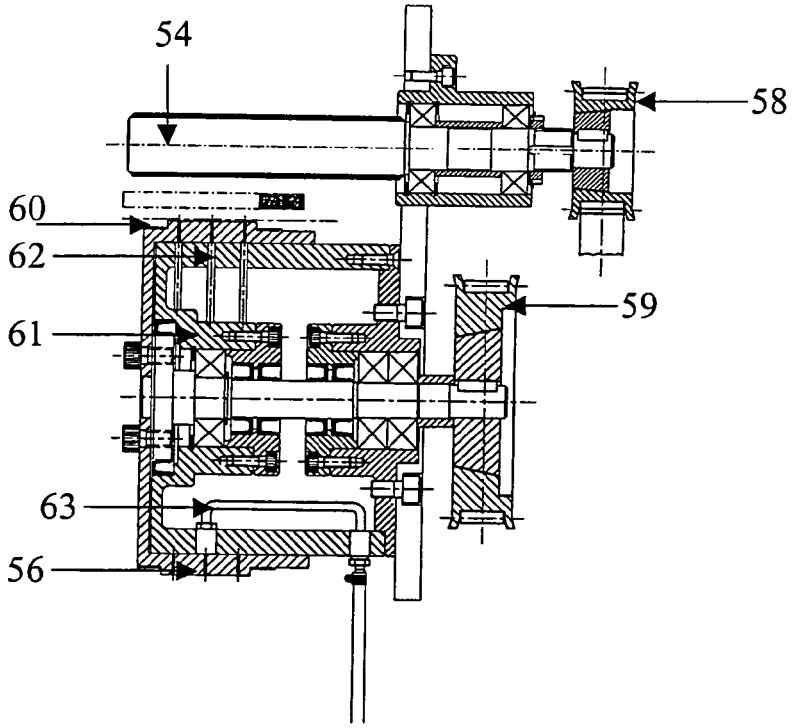
FIG. 24 is a cross section view of the inspection drum, wherein are depicted the inner cylinder, the outer cylinder, the compressed air pipe line for cigarette rejection and the counter-rotating roll.
Figure 25:
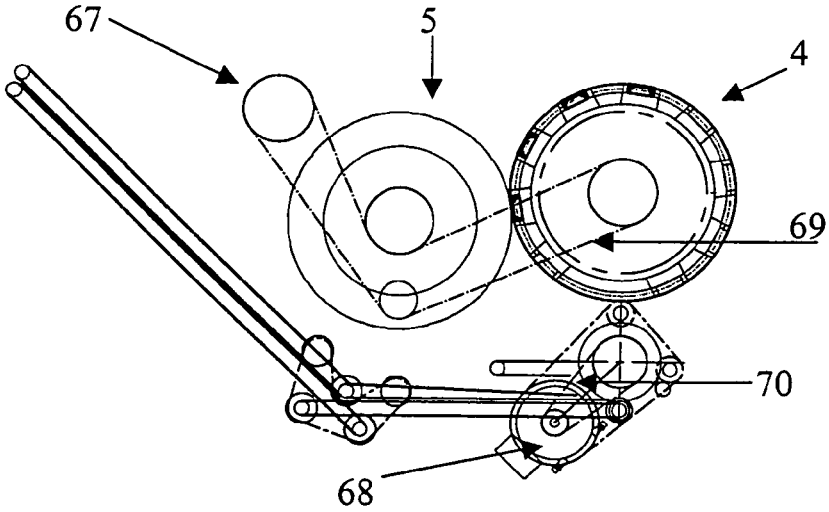
FIG. 25 shows the drive section of the machine, that is, the driving elements, belts and pulleys.
Figure 26:
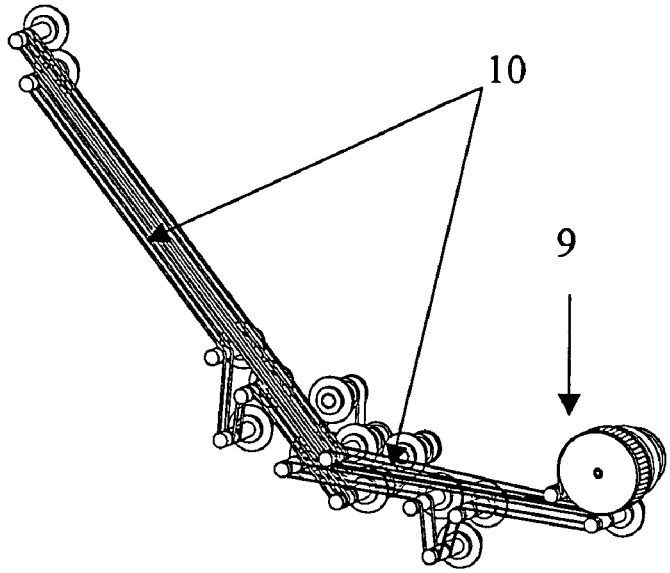
FIG. 26 shows the selected cigarettes collection belt.
Figure 27:
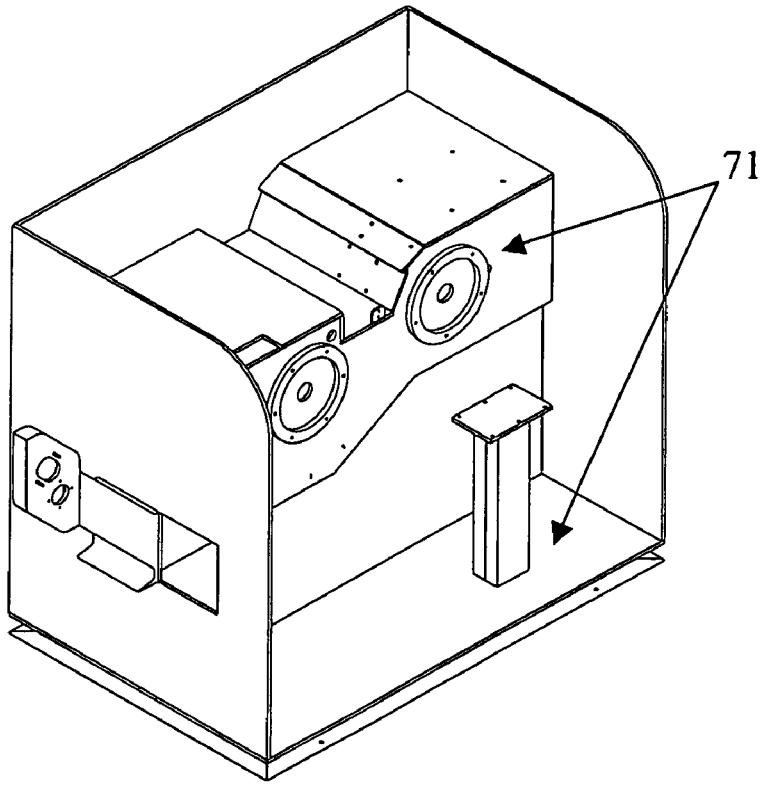
FIG. 27 shows the machine frame without the protection casing elements and the control panel.
Figure 28:
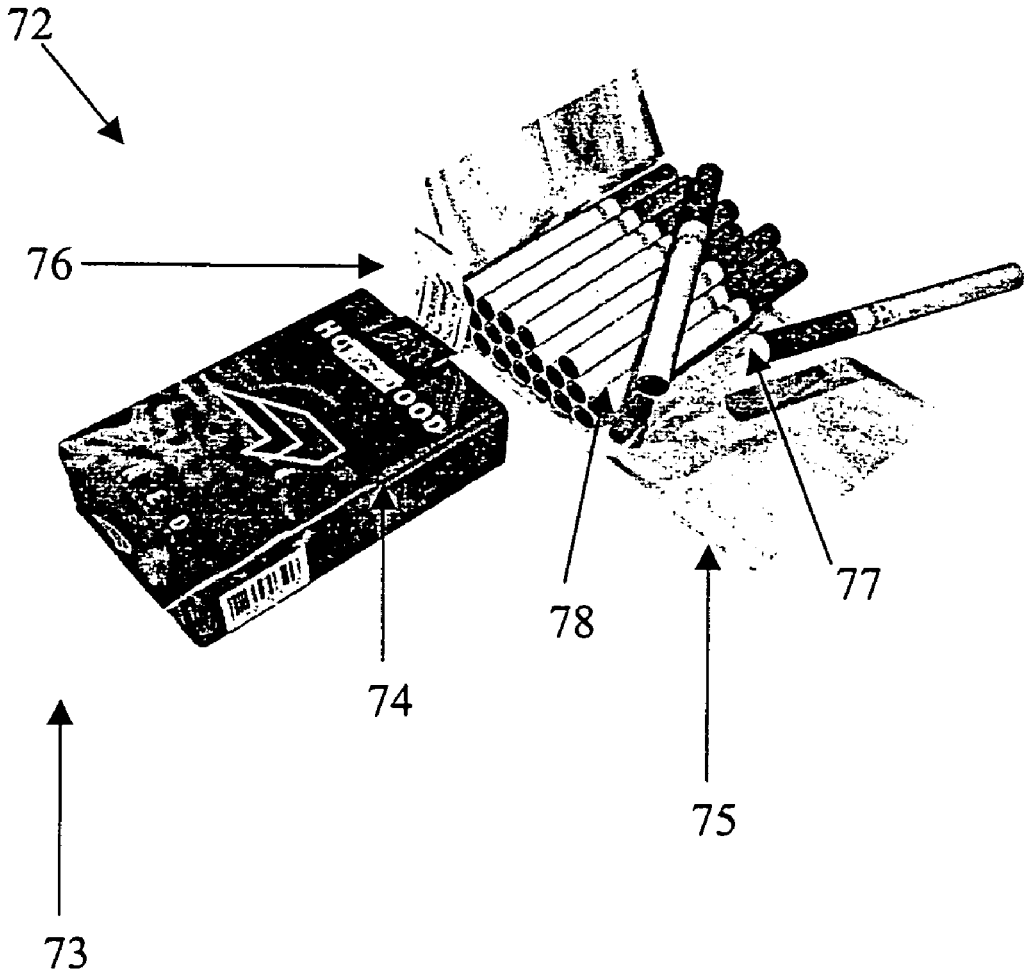
FIG. 28 shows the components of a soft cup type pack of cigarettes.

The cigarette pack opening and cigarette inspecting machine 1 that constitutes the object of the present invention, shown in FIGS. 1 to 4, is intended for the primary purpose of withdrawing cigarettes from within the soft cup type pack 72, inspecting those cigarettes and returning them to the production process if it is determined that they are fit to be used.

The undamaged soft cup type packs that are not wrapped in the polypropylene film 73 and are devoid of the closure seam tax stamp 76 are manually positioned onto each of the feed channels 23 of the cigarette pack accumulator 2 in one sole direction, that is, vertically upon one another.

The channel that is aligned with the transfer conduit 3 feeds the packs to the machine, while the remaining channels are being filled by the individual in charge. When all the packs in one channel are consumed by the machine, a sensor will detect that the channel is empty and will drive a pneumatically actuated piston 25 that will move the empty channel away from the transfer conduit. A motor-driven link-block belts system 24 allows a new channel filled with packs to move into alignment with the transfer conduit and to keep feeding the machine. The channels are driven by the link-block belts 24, and the channels may be transferred from one belt to another by means of two pneumatically actuated pistons 25 and 26.

The packs coming from channel 23 will fall by gravity through the transfer conduit 3 and are accommodated in the pack holding pouches 27 that are integral with the surface of the outer cylinder of the first drum 32. The packs remain stationary within the pouches due to the adherence provided by the internal coating of pouch 36 and due to the vacuum that is being applied to the pack from the pouch orifices 37 that are in alignment with the orifices 31 of the outer cylinder of the first drum 32, which in turn are in alignment with the orifices 20 of the inner cylinder 33 of the first drum, allowing the vacuum that exists within the inner cylinder to communicate with the pouch.

The outer cylinder of the first drum 4 driven by the driving device 67, by means of cogged belts 69 and pulleys 35, drives in intermittent motion the pack holding pouch towards the aluminum foil lining flaps opening device 28. When the pouch approaches the said device, a sensor sends a signal to drive the pneumatic actuation piston 39, pushing the claw 41 towards the pouch 27. The claw is inserted into the flaps of the aluminum foil lining 75 at the top of the pack causing the flaps to open when the pouch is moved, even if they are stuck by residual adhesive of the closure seam tax stamp. A spring 40 minimizes the impact of the claw against the pack, to avoid damaging the pack.

The aluminum foil lining flaps remain open along the course of travel to the flap pressuring and label housing displacing device due to the action of the guide means 42 that is attached to the device 29 itself.

Upon entry into the flap pressing and label housing displacing device 29, a sensor sends a signal for the two pneumatically driven pistons 45 to drive their respective flap presses which in turn will immobilize the flaps of the aluminum foil lining. When the aluminum foil lining is immobilized, the pneumatic piston 43 is actuated to push the rods 44 that displace the base of the pack holding pouch 36, causing the label housing 74, which is held to the pouch due to the vacuum and the adherence provided by the internal coating of the pouch, to move together with the movable base of the pouch, thus separating the same from the aluminum foil lining, which does not move together with the pouch.

When the pouch is moved, the plurality of orifices 37 thereof cease to be in alignment with the plurality of orifices of the outer cylinder of the first drum 46, thereby ending the communication with the vacuum from the inside of the inner cylinder 33. In this position, the orifices of the pouch are aligned with the compressed air line 34, which will detach the label housing from the adherent surface of the pouch, facilitating its removal by device 30, which will apply suction thereto and will discard it through the conveying duct 17, where the label housing will be sucked and conveyed to the label housing storage bin 11.

The pouch is provided at one of the ends thereof with a roller 38 that rolls along a cam path 79. The machine is designed in such manner that the moment when the pneumatically actuated piston 43 receives a signal from the electronic part of the machine to cease to actuate the pushrods 44 coincides with the moment when the roller 38 is passing by a region of the cam path that subjects the same to compression, causing the base of the pouch to return to its original position.

After the base of the pouch has returned to its original position, the pneumatically actuated pistons receive a signal from the electronic part of the machine to cease to actuate the flap presses 45, releasing the aluminum foil lining which will remain fixed by vacuum to the pouch, since the communication with the vacuum chamber is resumed by the realignment of the orifices of the outer cylinder 32 with those of the pouch 27.

The unopened cigarette packs are detected by a sensor in the pack rejection device 52 and are expelled by pushrods 66 driven by a pneumatically actuated piston 65 into a conveying duct 53 which will convey the same to the bin 22 where they will be stored.

The aluminum foil lining 75, containing the cigarettes within the same, will be opened at the intersection between the first drum 4 and the second drum 5. The orifices 46 of the outer cylinder of the second drum 48 are provided in alignment with the orifices of the inner cylinder 64, thereby allowing the vacuum coming from inside the inner cylinder 49 to act upon the surface of the outer cylinder of the second drum 48. When the holding pouch approaches the second drum 5, the vacuum present therein will suck the flaps of the aluminum foil lining. Since each of the two drums 4 and 5, by means of vacuum, holds one end of the aluminum foil lining, and since the drums rotate in opposite directions, the aluminum foil lining will be opened by the concomitant movement of the two drums. Upon the complete opening of the aluminum foil lining, the cigarettes are poured into the cigarette storage bin 6.

Subsequently, the outer cylinder 32 of the first drum passes by a region where there are no orifices in the inner cylinder 33, terminating the vacuum action, releasing the aluminum foil lining from the first drum 4, allowing the aluminum foil lining to remain attached only to the outer cylinder 48 of the second drum 5 by means of the vacuum provided from the inside of the inner cylinder 49 of the second drum. The second drum is driven by the same driving device 67 of the first drum, by means of a pulley 50 and cogged belts 69, providing an intermittent motion thereto.

At the intersection between the first drum 4 and the second drum 5 there are guide means for opening the top and bottom folds of the aluminum foil lining 51 that facilitate the full opening of the top and bottom flaps of the aluminum foil lining.

The aluminum foil lining remains attached to the outer cylinder 48 of the second drum until a region where the inner cylinder 49 is devoid of orifices, thus inhibiting the action of the vacuum on the outer cylinder, whereupon the aluminum foil lining will be released from the second drum 5 and will be conveyed by the conveying pipe 19, by means of suction, towards the aluminum foil linings storage bin 13.

In order to soften the impact of the cigarettes falling into the storage bin 6, avoiding that the same be damaged, there may optionally be installed a mesh screen in the storage bin.

The storage bin 6 is preferentially made of clear polycarbonate, for the purpose of allowing optimum visibility of the inside thereof, and allowing to detect crushing cigarettes.

The cigarettes stored in the cigarette storage bin 6 are picked up and sucked through the channels 55 of the inspection drum 9. The outer cylinder 60 of the inspection drum is provided with orifices 56 in each of the channels and the inner cylinder 61 is provided with orifices 62 along the surface thereof that allow the vacuum present within the same to act upon the surface of the outer cylinder when the orifices of both cylinders are placed in mutual alignment. Each channel 55 may store one single cigarette, which will be held therein by vacuum provided from the inside of the inner cylinder 61.

In order to avoid crushing the cigarettes against the walls of the storage bin 6, due to the rotating motion of the inspection drum 9, there is positioned a "counter-rotating roll" 54 at the interface between the storage bin 6 and the inspection drum 9 in order to minimize the pressure on the cigarettes. The outer cylinder of the inspection drum and the counter-rotating roll are driven, by means of pulleys 58 and 59 and cogged belts 70, by the same driving means 68 that provides a continuous rotating motion thereto.

The cigarettes are conveyed by the inspection drum towards the inspection device 57 that uses an optical sensor and an infrared sensor to respectively detect the presence of the cigarette filter tip 77 and whether the end of the tobacco tube 78 is duly filled with tobacco, that is, if the cigarette tube is not entirely filled with tobacco up to the end thereof.

If the cigarette is perfect it will remain attached to the inspection drum, otherwise there will be sent a signal to the electronic part of the machine that will cause a jet of air to blow the cigarette towards the conveying pipe 17 that will convey the same, by means of suction, towards the rejected cigarettes storage bin 11. The jet of air is provided from an orifice located centrally in the channel. This orifice is connected to a compressed air pipe line 63 which crosses the inner and outer cylinders, the compressed air pressure being sufficient to prevail over the action of the vacuum that is applied to the cigarette.

The cigarettes that may be recovered back to the production process are conveyed by the outer cylinder 60 towards a region of the inspection drum where there are no openings in the inner cylinder 61, ceasing the action of the vacuum on the outer cylinder of the inspection drum, allowing the cigarettes to be poured onto a cigarette collection belt 10, which will convey the same to an equipment that will store the cigarettes in bins.

The vacuum and the compressed air used by the machine are usually provided by the manufacturing facility itself. However, an auxiliary vacuum pump may optionally be coupled to the machine to warrant the presence of an optimum vacuum level inside the three internal cylinders of the machine.

The machine is provided with a frame 71 whereto are attached all the fixed components mentioned above and also the machine protection casing elements 7 and 8, and the electrical and electronic part of the machine. Next to the frame 71 there is located a control panel 21.

The invention claimed is:

1. A machine for opening cigarette packs and inspecting cigarettes (1), used to recover cigarettes contained in soft cup type packs(72), characterized by comprising:

a cigarette pack accumulator (2), which comprises a plurality of pack storage channels (23) that are displaced by means of two link-block belts (24) moving in opposite directions, driven by one or more driving means, each channel (23) being capable of being transferred from one belt to another by means of two pneumatically actuated pistons (25,26);

a transfer channel (3) in the shape of a half-tube with rectangular cross section, comprising guide means;

a first drum (4), comprised of a fixed inner cylinder (33), secured to the frame of the machine (71), and a movable outer cylinder (32) driven by a driving device (67), by means of cogged belts and pulleys (69,35), providing an intermittent motion thereto, wherein the inner cylinder is provided along the surface thereof with a plurality of orifices (20), and which internal space is under vacuum, and wherein along the periphery of the outer cylinder there are provided a plurality of orifices(31), the first drum (4) further comprising a compressed air pipe line (34) which crosses both cylinders and reaches the surface of the outer cylinder;

cigarette pack holding pouches (27) attached to the surface of the outer cylinder (32), containing a plurality of orifices (37), internally coated with an adhesive material, wherein the base (36) of each pouch is movable and at one of the ends thereof there being provided a roller (38) that rolls along a cam path (79);

a device for opening flaps of an aluminum foil lining (28) comprised by a pneumatically actuated piston (39), a claw (41), and a spring (40); a guide means (42), attached to a flap pressing and label housing displacing device (29) that maintains the full opening of both flaps of the aluminum foil lining;

the flap pressing and label housing displacing device (29) comprised by two pneumatically actuated pistons (45)

that drive flap presses, and a pneumatically actuated piston (43) that drives pushrods (44) and a device (30) for applying suction to and discarding the label housing;

an unopened packs rejection device (52) that comprises a pneumatically actuated piston (65) and pushrods (66);

a second drum (5), comprised of a fixed inner cylinder (49), secured to the machine frame (71), by a movable outer cylinder (48) driven by a driving device (67), by means of cogged belts and pulleys (69,50), providing an intermittent motion thereto, wherein the inner cylinder is provided along its surface with a plurality of orifices (64), and where its internal space is under vacuum, wherein along the periphery of the outer cylinder there is provided a plurality of orifices (46);

a guide configured to open top and bottom flaps of the aluminum foil lining (51);

a cigarette storage bin (6);

a counter-rotating roll (54);

an inspection drum (9) comprised by a fixed inner cylinder (61), secured to the machine frame (71), and by a movable outer cylinder (60) driven by a driving device (68), by means of cogged belts and pulleys (70,59,58), providing a continuous motion thereto, wherein the inner cylinder is provided along the surface thereof with a plurality of orifices (62), and which internal space is under vacuum, wherein along the surface of the outer cylinder there are provided channels (55) and a plurality of orifices (56) to allow the action of the vacuum, and also openings located centrally in the channels in communication with a compressed air pipe line (63) in a cigarette rejection region;

a cigarette inspection device (57) comprised of an optical sensor that checks the presence of a filter tip and an infrared sensor that checks the condition of the end of the cigarette tobacco tube;

a cigarette rejection device that receives a signal from the inspection device and performs the rejection of a cigarette that fails to meet the quality standard by means of a jet of air blown from the compressed air pipe line (63) provided from an opening (56) located centrally in the channel;

storage bins for label housings (12), aluminum foil linings (13), and cigarettes(11) wherein are stored the objects discarded by the machine, each bin comprising a fan (15,16, 14) and conveying pipes (18,19, 17);

rejected cigarette packs storage bin (22), comprised of a bin located at the lower part of the machine and a conveying duct (53);

selected cigarettes collector belt (10), driven by the driving means (68) of the inspection drum; and a frame (71), whereto are attached all the fixed components of the machine, and also protection casing elements (7,8), and electrical and electronic parts of the machine, a control panel (21) being located next to the frame (71).

2. A machine, according to claim 1, characterized by further comprising an auxiliary vacuum pump.

3. A machine, according to any one of claims 1 or 2, characterized in that each channel (55) stores one single cigarette.

4. A machine, according to claim 1, characterized in that the cigarette storage bin (6) contains a mesh screen.

5. A machine, according to claim 1, characterized in that the cigarette storage bin (6) is transparent.

6. A machine, according to claim 1, characterized in that the cigarette storage bin (6) is made of polycarbonate.

7. A machine, according to claim 1, characterized in that the adhesive material of the internal coating of the holding pouch is polyurethane.

* * * * *